United States Patent [19]

Sands

[11] Patent Number: 4,672,698

[45] Date of Patent: Jun. 16, 1987

[54] BED RAIL CUSHION SYSTEM

[76] Inventor: Donald F. Sands, 2701 Chapel Pike, Marion, Ind. 46952

[21] Appl. No.: 826,984

[22] Filed: Feb. 7, 1986

[51] Int. Cl.[4] ..... A47C 27/08

[52] U.S. Cl. ..... 5/424; 5/52; 5/100; 5/280; 5/508; 297/440

[58] Field of Search ..... 5/52, 53 R, 100, 280, 5/424, 425, 508, 512, 513; 297/440

[56] References Cited

U.S. PATENT DOCUMENTS

| | | | |
|---|---|---|---|
| 2,624,891 | 1/1953 | Katzoff | 5/280 |
| 3,036,864 | 5/1962 | Arai | 297/440 |
| 3,170,729 | 2/1965 | Grant | 297/440 |
| 3,742,530 | 7/1973 | Clark | 5/425 |
| 4,109,887 | 8/1978 | Wakeland, Jr. | 5/100 |
| 4,215,446 | 8/1980 | Mahoney | 5/425 |
| 4,514,871 | 5/1985 | Fisher et al. | 5/424 |

FOREIGN PATENT DOCUMENTS

| | | | |
|---|---|---|---|
| 185946 | 9/1955 | Austria | 5/53 R |
| 859692 | 1/1961 | United Kingdom | 5/280 |

*Primary Examiner*—Gary L. Smith
*Assistant Examiner*—Michael F. Trettel
*Attorney, Agent, or Firm*—Roger M. Rickert

[57] ABSTRACT

Rigid bed rail pads with resilient outer surfaces for headboard, footboard and siderails of hospital style beds are disclosed wherein the padding is dimensioned to provide a gap free junction between the padded rails and the bed mattress so as to avoid patient injury. The pads are readily removed and cleaned and allow normal raising and lowering of siderails on a hospital bed while the pads are in position.

13 Claims, 3 Drawing Figures

BED RAIL CUSHION SYSTEM

CROSS-REFERENCE TO RELATED APPLICATIONS

The ornamental features of this invention are disclosed and claimed in copending design U.S. application Ser. No., 827,105 filed on even date herewith, the entire disclosure of which is specifically incorporated herein by reference.

SUMMARY OF THE INVENTION

The present invention relates generally to removable padding arrangements for furniture and particularly for hospital type beds where a padding is sometimes desirable to prevent patient injury. More particularly, the present invention relates to a series of removable pads for the side, head, and foot rails of such a patient's bed which are readily affixed and removed by a simple vertical lifting motion.

Removable padding arrangements for beds are known as illustrated, for example, by U.S. Pat. Nos. 421,656; 3,742,530; 4,215,446 and West German Pat. No. 614,367. These siderail padding arrangements are of two general types, the first being where the padding arrangement and the siderail for the bed are an integral arrangement and must be affixed to or removed from the bed together. A second type relates to padding arrangements to cover the existing siderails on hospital type beds with these being a relatively thin flexible padding arrangement which folds over and snaps to the bed siderail. The integral type padding arrangements are inconvenient and not adaptable to a wide variety of currently manufactured beds while the latter variety provide at best inadequate padding and typically allow the patient a gap or space between the bed mattress and the padded rail into which an arm, elbow or ankle may easily slip providing an opportunity for patient injury. It would be highly desirable to have a padding arrangement for a hospital type bed which was readily attached or removed and which completely filled any gap between the mattress and the pad while affording the patient maximum padding protection.

Among the several objects of the present invention may be noted the provision of a bed rail cushion system which achieves the above noted goal while avoiding the above noted prior art deficiencies; the provision of a bed rail cushion system for a patient's bed of the type having siderails movable between raised and lowered positions which cushion system does not interfere with the raising and lowering of those siderails; the provision of a pad arrangement adaptable to bed siderails as well as head or foot boards which allows a patient greater freedom of movement while reducing or precluding patient injuries; the provision of a bed rail cushion system employing readily cleansed or sanitized polyvinyl chloride outer covering which is readily removed from a bed, adaptable to most varieties of hospital beds, and which does not interfere with normal raising and lowering of the siderail on such a bed. These as well as other objects and advantageous features of the present invention will be in part apparent and in part pointed out hereinafter.

In general, a cushion system for a patient's bed includes at least two similar siderail pads each having an inverted generally "J" shaped cross-sectional configuration with an inner relatively rigid frame and a resilient padding surrounding the frame with the padding being of a thickness sufficient to abut the lateral edge of a bed mattress when the pad is positioned on a siderail and the siderail is in a raised position. The system further includes headboard and footboard pads having an inverted generally "U" shaped cross-sectional configuration with an inner relatively rigid frame and a similar resilient padding surrounding the frame. Both the siderail pads and the headboard and footboard pads include a vinyl sheath covering the padding to provide an easily sanitized surface.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
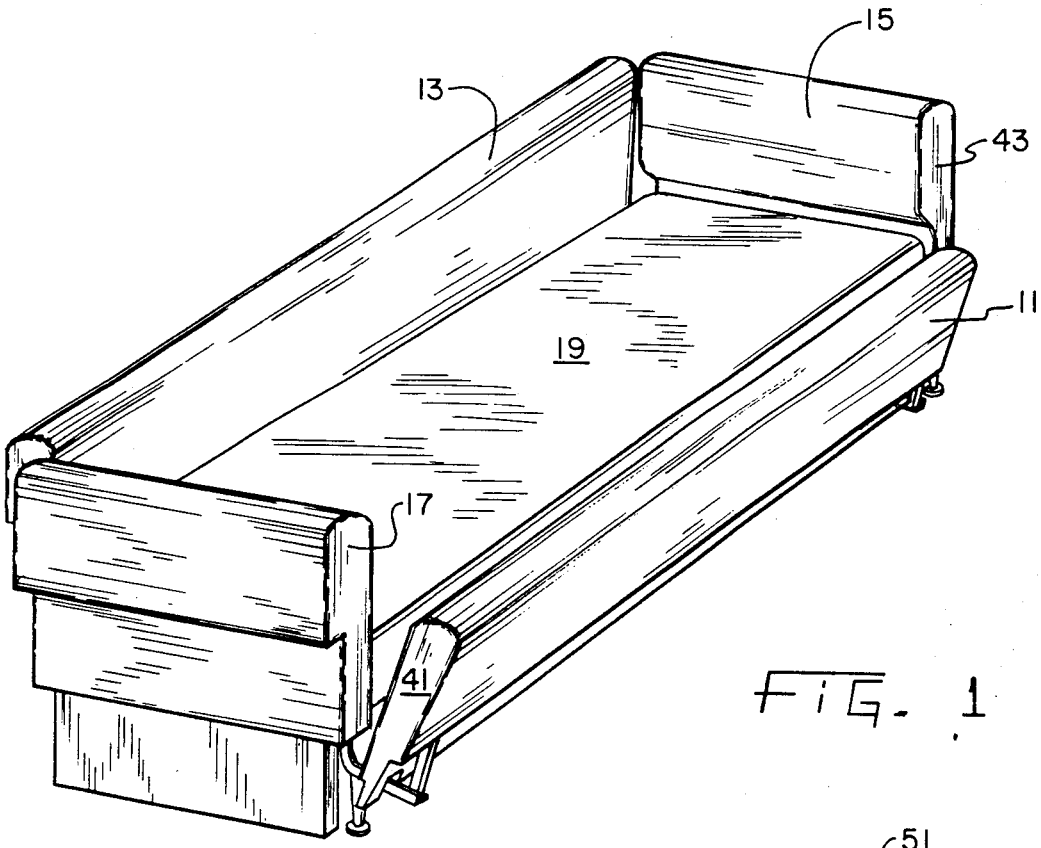
FIG. 1 is a perspective view of a hospital style bed having a siderail, headboard and footboard pads and with one siderail in the lowered position.

In the perspective view of FIG. 1, the bed rail cushion system includes a pair of siderail pads 11 and 13, headboard pad 15, and footboard pad 17 positioned on a patient's bed having a mattress 19 and of a well known type where each of the pair of siderails covered by pads 11 and 13 is movable between a lowered position as illustrated for the rail covered by pad 11 in which patient ingress and egress is facilitated, and a raised position illustrated by the rail covered by pad 13 for preventing a patient from inadvertently falling out of bed. Except as described hereinafter, the two siderail pads 11 and 13 are substantially identical and the head and footboard pads 15 and 17 are substantially identical.

Figure 2:
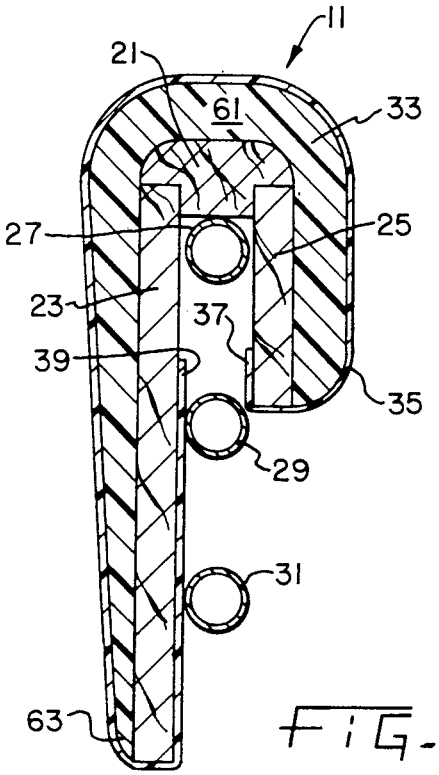
FIG. 2 is a cross-sectional view through one of the siderail pads of FIG. 1.

The siderail pads such as 11 as illustrated in FIG. 2 has a generally inverted "J" shaped cross-sectional configuration and relatively rigid inner frame formed from a "T" shaped wooden rail 21 and a pair of generally flat spaced apart elongated side walls 23 and 25 which are fastened as by screws or gluing to the rail 21 and depend therefrom defining between the side walls 23 and 25 a cavity or gap for receiving the bed siderail as illustrated by the siderail bars 27, 29, and 31. These horizontal bars 27, 29, and 31 make up the siderail portion of the patient's bed and are together movable in a standard hospital bed between the raised and lowered positions discussed above. The side walls 23 and 25 may be of plywood or similar material while the "T" shaped wooden rail 21 is formed from a conventional 2×4 appropriately notched and contoured.

The outer surfaces of the "J" shaped wooden frame are covered with a foam padding 33 and this foam padding is in turn covered by an outer covering such as a polyvinyl chloride sheath 35 which provides an outer surface for the bed rail cushion which is easily cleaned or sanitized. The ends of the vinyl covering are tucked under and tacked or glued as at 37 and 39 to the bed rail receiving cavity inner surface.

Comparing FIGS. 1 and 2, it will be noted that the end 41 of rail 11 is closed as by an end sheet of plywood covered with foam padding and a vinyl skin. The opposite end of siderail pad 11 may be similarly closed or may be left open in the general configuration of the cross-sectional view of FIG. 2 if it is desired that the siderail pad be adaptable to several different siderail length beds. The headboard pad 15 and footboard pad 17 typically have at both ends such as 43 enclosed as is end 41 of siderail pad 11.

Figure 3:
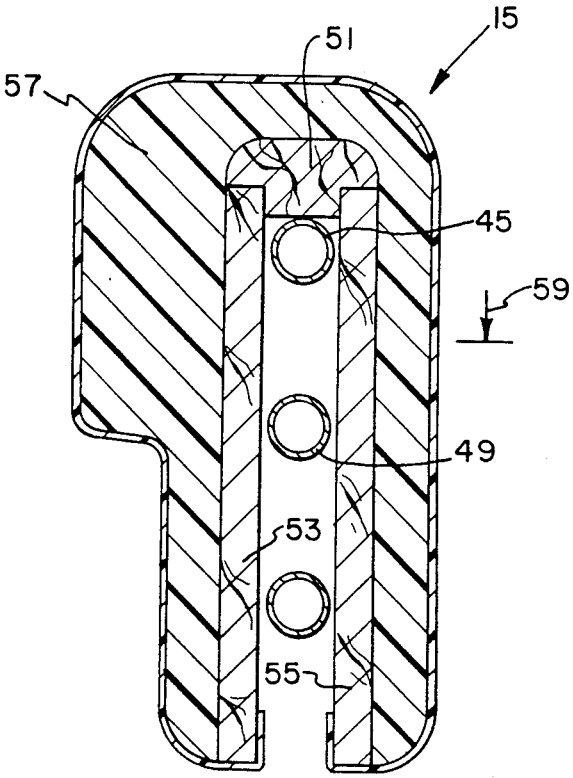
FIG. 3 is a cross-sectional view similar to FIG. 2 but through the headboard pad of FIG. 1.

Referring now to FIG. 3, the hospital bed footboard may comprise a series of horizontal bars such as 45, 47, and 49 while the headboard pad itself is generally of an inverted "U" shaped cross-sectional configuration with a somewhat similar rigid inner frame formed of an upper rail 51 and a pair of generally flat spaced apart elongated side walls 53 and 55. Comparing FIGS. 2 and 3, it will be noted in FIG. 3 that the side walls are of generally the same vertical extension and that additional padding in the region 57 has been provided so that the area near the patient's head is particularly well padded. The structure of the headboard 15 is otherwise very much the same as that of the siderails 11 except, of course, for the dimensions.

Footboard 17 is very similar in cross-sectional configuration to that of headboard 15 as illustrated in FIG. 3, however, the upper rail 51 has the bottom surface thereof extending further downwardly as to the level indicated by arrow 59 to compensate for the fact that the uppermost horizontal bar of the footboard is positioned lower than the uppermost bar 45 of the headboard. The head and footboard pads are otherwise substantially similar.

In one preferred embodiment of the invention, the thickness of the padding in region 61 was about two inches, while this padding tapered in a downward direction as viewed in FIG. 2 so that the thickness near the bottom as in region 63 was only about one inch. For this particular illustrated embodiment, the head and footboard pads were about 39 inches in lateral length and about 15 inches in height, while the siderail pads 11 and 15 were about 78 inches in length and 15 inches in height.

From the foregoing, it is now apparent that a novel bed rail cushion system has been disclosed meeting the objects and advantageous features set out hereinbefore as well as others and that modifications as to the precise configuration, shapes and details may be made by those having ordinary skill in the art without departing from the spirit of the invention or the scope thereof as set out by the claims which follow:

What is claimed is:

1. In combination with a patient's bed of the type having a mattress and a pair of siderails each movable between a lowered position for facilitating patient ingress and egress and a raised position for preventing a patient from inadvertently falling out of bed, a bed rail cushion including at least two like siderail pads, each siderail pad having an inverted generally "J" shaped cross-sectional configuration with an inner relatively rigid frame defining a cavity for receiving a bed siderail and a resilient padding surrounding the frame, the pad being removably positioned on the bed with the siderail within the cavity and movable with the siderail between said lowered and raised positions, the padding being of a thickness sufficient to firmly abut the lateral edge of the mattress completely filling the gap between the rail and the mattress when the pad is positioned on the siderail and the siderail is in a raised position.

2. The bed rail cushion system of claim 1 wherein each siderail pad further includes a vinyl sheath covering the padding to provide an easily sanitized surface.

3. The bed rail cushion system of claim 1 wherein the inner frame comprises an upper rail and a pair of generally flat spaced apart elongated side walls depending from the upper rail and defining therebetween said bed siderail receiving cavity.

4. The bed rail cushion system of claim 3 wherein the upper rail and side walls are wooden.

5. The bed rail cushion system of claim 1 further including a headboard pad having an inverted generally "U" shaped cross-sectional configuration with an inner relatively rigid frame and a resilient padding surrounding the frame.

6. The bed rail cushion system of claim 5 wherein the headboard pad further includes a vinyl sheath covering the padding to provide an easily sanitized surface.

7. The bed rail cushion system of claim 6 wherein the inner relatively rigid frame of the headboard pad comprises an upper rail and a pair of generally flat spaced apart elongated side walls depending from the upper rail and defining therebetween a bed headboard receiving cavity.

8. The bed rail cushion system of claim 7 wherein the upper rail and side walls are wooden.

9. The bed rail cushion system of claim 1 further including a footboard pad having an inverted generally "U" shaped cross-sectional configuration with an inner relatively rigid frame and a resilient padding surrounding the frame.

10. The bed rail cushion system of claim 9 wherein the footboard pad further includes a vinyl sheath covering the padding to provide an easily sanitized surface.

11. The bed rail cushion system of claim 10 wherein the inner frame comprises an upper rail and a pair of generally flat spaced apart elongated side walls depending from the upper rail and defining therebetween a bed footboard receiving cavity.

12. The bed rail cushion system of claim 11 wherein the upper rail and side walls are wooden.

13. The bed rail cushion system of claim 1 further including a headboard pad and a footboard pad each having an inverted generally "U" shaped cross-sectional configuration with inner relatively rigid frames and resilient padding surround the frames, and with vinyl sheaths covering the padding to provide an easily sanitized surface.

* * * * *